United States Patent [19]

Kiley

[11] 4,282,113

[45] Aug. 4, 1981

[54] BLACK SMOKE GENERATOR

[75] Inventor: Leo R. Kiley, Whitehall, Mich.

[73] Assignee: Teledyne Industries, Inc., Los Angeles, Calif.

[21] Appl. No.: 83,286

[22] Filed: Oct. 10, 1979

[51] Int. Cl.[3] ..... F41H 9/06

[52] U.S. Cl. ..... 252/359 CG

[58] Field of Search ..... 252/359 R, 359 A, 359 CG; 60/606, 735

[56] References Cited

U.S. PATENT DOCUMENTS

| | | | |
|---|---|---|---|
| 2,620,621 | 12/1952 | Nettel | 60/606 X |
| 2,857,332 | 10/1958 | Tenney et al. | 252/359 CG |
| 3,024,200 | 3/1962 | Smith | 252/359 A |
| 3,163,984 | 1/1965 | Dumont | 60/606 |
| 3,244,641 | 4/1966 | Durr et al. | 252/359 CG |
| 3,432,439 | 3/1969 | Dickman | 252/359 A |
| 3,502,846 | 3/1970 | Porwancher | 252/359 R X |
| 3,573,223 | 3/1971 | Anderson | 252/359 A |
| 3,990,987 | 11/1976 | Rogers | 252/359 A |
| 4,112,684 | 9/1978 | Tholen | 60/606 |

FOREIGN PATENT DOCUMENTS

| | | | |
|---|---|---|---|
| 681554 | 3/1964 | Canada | 252/359 CG |

*Primary Examiner*—Bradley Garris

*Attorney, Agent, or Firm*—Gifford, VanOphem, Sheridan & Sprinkle

[57] ABSTRACT

A black smoke generator is provided for generating a smoke screen for use on military vehicles, installations and the like. In one form of the invention, the black smoke generator is a self-contained and self-sustaining unit and comprises a compressor having an air intake and a compressed air outlet and a turbine having an inlet and an exhaust outlet. A shaft is drivingly connected between the turbine and the compressor so that gases expanding through the turbine expander rotatably drive the shaft which in turn rotatably drives the compressor. A burner assembly having a housing which defines a combustion chamber is interposed between the compressor outlet and the turbine inlet while a source of fuel is connected to the combustion chamber and feeds fuel to the combustion chamber at a rate which produces an excessively rich fuel/air mixture in the combustion chamber. Upon ignition of the fuel/air mixture, black smoke is exhausted through the turbine which simultaneously drives the compressor. In a modified form of the invention, the smoke generator is adapted for use with an engine turbocharging system and includes a burner housing defining a combustion chamber. A portion of the air from the compressor of the turbocharging system is fed to the burner combustion chamber while fuel is supplied to the burner combustion chamber at a rate which produces an excessively rich fuel/air mixture. The outlet from the burner combustion chamber is fluidly connected to the exhaust outlet from the turbocharging system turbine expander so that upon ignition of the fuel/air mixture in the burner combustion chamber, black smoke is produced which intermixes with the turbine exhaust from the turbocharging system.

3 Claims, 2 Drawing Figures

BLACK SMOKE GENERATOR

BACKGROUND OF THE INVENTION

I. Field of the Invention

The present invention relates generally to smoke generators and, more particularly, to a black smoke generator.

II. Description of the Prior Art

Smoke generators are employed on a number of different military vehicles and the like for producing a smoke screen to hide or obscure the military vehicle. Previously, these military vehicles have utilized smoke generators to produce a cloud of smoke which encompasses the vehicle.

These previous smoke generators, however, are disadvantageous for a number of different reasons. First, the smoke generators require a separate and special energy source which must be carried on board the military vehicle, for example smoke grenades. Thus, when the energy source for the smoke generator has been exhausted, the vehicle cannot generate smoke until the energy source has been replenished. Replenishment of the energy source in the field, however, is oftentimes impractical or impossible.

A still further disadvantage of the previously known white smoke generators which rely on vaporized fuel is that while the white smoke generator provides adequate visual protection for the military vehicle, no shielding from infrared detection devices is obtained.

For these reasons, white smoke generators have been used only with limited success with military vehicles and the like.

SUMMARY OF THE PRESENT INVENTION

The present invention overcomes the disadvantages of the previously known smoke generators by providing a smoke generator for a military vehicle or the like which operates on the same fuel as the vehicle and which also provides greater shielding from infrared detection devices than the previously known white smoke generators.

In one form of the invention, the smoke generator is a self-energizing and self-sustaining unit and comprises a turbine compressor having an air intake and a compressed air outlet and a turbine expander having an inlet and an exhaust gas outlet. A turbine shaft interconnects the turbine with the compressor so that as gases expand through the turbine, the turbine rotatably drives the shaft which, in turn, rotatably drives the compressor.

The smoke generator further comprises a burner housing defining a combustion chamber and having an inlet and an outlet. The combustion chamber inlet is connected to the compressed air outlet from the compressor while, similarly, the outlet from the combustion chamber is connected to the turbine inlet. In addition a source of fuel, such as diesel fuel, is supplied to the combustion chamber at a flow rate which produces an excessively rich fuel/air mixture within the combustion chamber. Thus, upon ignition of the fuel/air mixture within the combustion chamber, excessive black smoke is generated which exhausts through the turbine and out the turbine exhaust outlet.

The exhausting of the black smoke through the turbine expander rotatably drives the turbine shaft and thus the compressor so that the black smoke generator is self-sustaining. Moreover, since the black smoke exhausting from the turbine exhaust is of a highly elevated temperature, improved shielding from infrared detection devices is obtained.

In a modified form of the invention, the black smoke generator according to the present invention is intended for use in conjunction with a diesel engine turbocharging system. Such a turbocharging system comprises an air compressor having an air intake and a compressed air outlet, a turbine expander having an inlet and exhaust outlet and drivingly connected to the compressor and a main fuel combustion chamber fluidly connected in between the compressor outlet and the turbine inlet.

In this modified form of the invention, the black smoke generator includes a burner housing defining a combustion chamber having an inlet and an outlet. The burner combustion chamber inlet is fluidly connected to the compressor outlet from the turbocharging system so that a portion of the air from the compressor outlet is fed to the burner combustion chamber. Similarly, the outlet from the burner combustion chamber is connected to the exhaust outlet from the turbine expander.

A source of fuel, and preferably the same diesel fuel used by the vehicle main engine, is fed to the burner combustion chamber at a rate which produces an excessively rich fuel/air mixture within the burner combustion chamber. Thus, upon ignition of the fuel/air mixture within the burner, excessive black smoke is produced which intermixes with the exhaust from the turbine expander.

In this modified form of the invention, no special logistical support is required to fuel the black smoke generator since it utilizes the same fuel as the main engine. Moreover, in both forms of the invention, the black smoke is either intermixed with or forms the exhaust outlet from the turbine expander. The black smoke is made up of soot particles which form nonspherical shapes and agglomerate into larger particles providing screening from infrared detection devices.

BRIEF DESCRIPTION OF THE DRAWINGS

A better understanding of the present invention will be had upon reference to the following detailed description when read in conjunction with the accompanying drawing, wherein like references characters refer to like parts throughout the several views, and in which.

DETAILED DESCRIPTION OF THE PRESENT INVENTION

Figure 1:
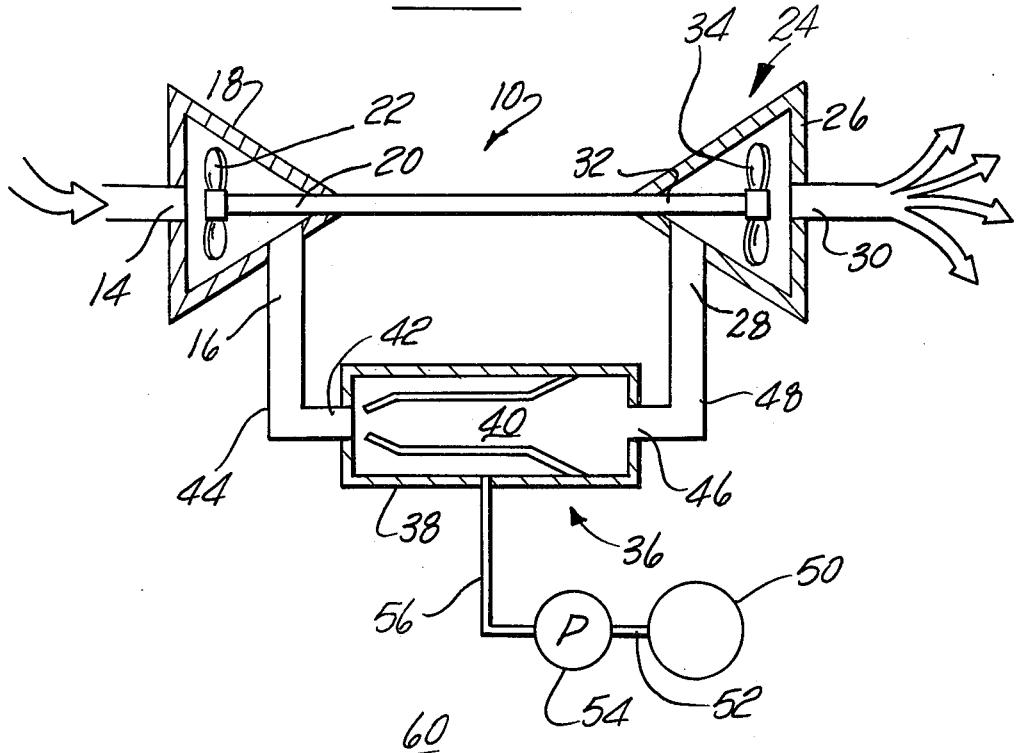
FIG. 1 is a diagrammatic view illustrating one form of the smoke generator according to the present invention.

With reference first to FIG. 1, one form of the smoke generator 10 according to the present invention is thereshown which is self-energizing and sustaining in operation as will become shortly apparent. Consequently, the smoke generator 10 illustrated in FIG. 1 can be advantageously employed as a smoke generator for a military vehicle or, alternatively, a military installation or the like.

Still referring to FIG. 1, the smoke generator 10 comprises an air compressor means 12 having an air intake 14 and a compressed air outlet 16. Preferably the compressor means 12 is a turbine compressor and, as such, includes a housing 18 in which a compressor driven shaft 20 is rotatably mounted. A compressor wheel 22 (illustrated only diagrammatically) is secured to the shaft 20 within the compressor housing 18 so that, upon rotation of the shaft 20, the compressor means 12 inducts air from its air intake 14 and produces compressed air at its outlet 16.

The smoke generator 10 further comprises an expander means 24 having a housing 26 with an inlet 28 and an exhaust outlet 30. Preferably the expander means 24 is a turbine expander and, as such, includes a drive shaft 32 rotatably mounted to the housing 26 and a turbine wheel 34 secured to the shaft 32 within the expander housing 26. The flow of gases from the expander inlet 28 and to its outlet 30 rotatably drives the turbine wheel 34 which in turn rotatably drives the expander drive shaft 32. Moreover, the expander shaft 32 is mechanically connected with the compressor shaft 20 so that rotation of the expander shaft 32 in turn rotatably drives the compressor driven shaft 20. Any conventional means can be used to drivingly connect the expander shaft 32 with the compressor shaft 20 or, alternatively, the shafts 32 and 20 can be of a one-piece construction.

Still referring to FIG. 1, the smoke generator 10 of the present invention further comprises a burner assembly 36 having a burner housing 38 which defines an interior combustion chamber 40. The burner housing 38 includes a compressed air inlet 42 which is fluidly connected by fluid conduit means 44 to the compressed air outlet 16 from the compressor 12. Similarly, the burner housing 38 includes an outlet 46 which is fluidly connected by fluid conduit means 48 to the expander inlet 28.

A source of fuel 50 is fluidly connected by a conduit 52 to a pump means 54 which, upon activation, pumps fuel from the fuel source 50 and to the combustion chamber 40 via conduit 56. Moreover, the pump means 54 is designed to supply fuel to the combustion chamber 40 at a rate which produces an excessively rich fuel/air mixture in the combustion chamber 40. In addition, the fuel within the fuel source 50 is preferably a hydrocarbon fossil fuel, such as diesel fuel.

As should be clear from the foregoing, the smoke generator 10 depicted in FIG. 1 is, in effect, a turbine engine with the exception that the pump means 54 provides an excessively rich fuel/air mixture to the combustion chamber 40. Thus, the smoke generator 10 is started in any conventional fashion and the excessively rich fuel/air mixture within the combustion chamber 40 is ignited by conventional means. Upon ignition, the hot and expanding gases from the combustion chamber 40 exhaust through the expander means 24 and, in doing so, rotatably drive the compressor means 18 via the shafts 32 and 20. Consequently, the smoke generator 10 depicted in FIG. 1 is self-sustaining in operation.

Since the pump means 54 supplies fuel to the combustion chamber 40 at a rate sufficient to provide an excessively rich fuel/air mixture, the combustion of the fuel-/air mixture within the combustion chamber 40 generates large quantities of black smoke and this black smoke expands through the turbine expander and is exhausted from its outlet 30 to provide the desired smoke screen. Moreover, the black smoke which is exhausted from the turbine expander is made up of soot which provides improved shielding from infrared detection devices over the previously white smoke generators.

Figure 2:
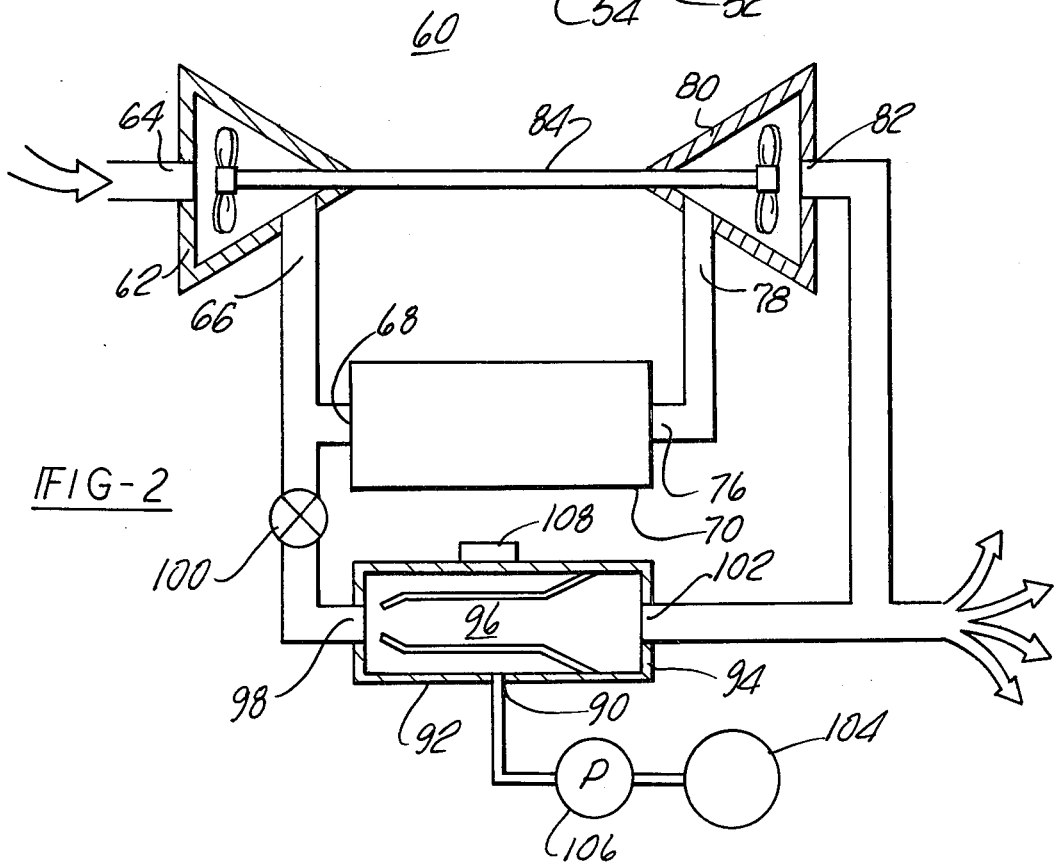
FIG. 2 is a diagrammatic view of a modified form of the smoke generator according to the present invention.

With reference now to FIG. 2, a modified form of the smoke generator according to the present invention is thereshown for use with a turbocharged diesel engine system 60 of the type commonly found on military vehicles and the like. The turbocharged diesel engine system 60 in general comprises an air compressor 62 having an air intake 64 and a compressed outlet 66. The compressed outlet 66 is connected to the inlet 68 of the diesel engine combustion chamber. The outlet 76 from the diesel engine chamber 70 is open to the inlet 78 of a turbine expander 80 having a turbine wheel and an exhaust outlet 82. As is conventional with turbocharging systems, the turbine wheel in the turbine expander 80 is connected to a drive shaft 84 which is drivingly connected with the compressor wheel in the compressor means 62.

In this modified form of the invention, the smoke generator 90 according to the present invention comprises a burner assembly 92 having a housing 94 which defines an interior combustion chamber 96. The housing 92 further includes an inlet 98 which is connected to the compressed air outlet 66 of the engine compressor means 62 via a normally closed restrictor valve 100. Similarly, the housing 92 includes an outlet 102 which is connected to the engine turbine exhaust 82 so that gas exhausting from the burner combustion chamber 96 becomes intermixed with the exhaust from the turbocharger engine 60.

A fuel source 104 is fluidly connected to the inlet of a pump 106 which, upon activation, supplies fuel to the burner combustion chamber 96. Any conventional means 108, moreover, are used to initiate combustion within the burner combustion chamber 96.

In operation, the valve 100 is normally closed during start up and normal operation of the engine 60. When smoke generation is desired, however, the valve 100 is opened slightly which bleeds a relatively small portion of the compressed air from the compressor outlet 66 and feeds this relatively small portion to the burner combustion chamber 96. Simultaneously, the pump 106 is activated which supplies fuel from the source 104 and to the burner combustion chamber 96 at a rate sufficient to produce an excessively rich fuel/air mixture within the burner combustion chamber 96. Upon ignition of this excessively rich fuel/air mixture by the ignition means 108, black smoke is produced due to the excessively rich fuel/air mixture and this black smoke exhausts out through the burner housing outlet 102 and becomes intermixed with the exhaust gas stream from the turbine exhaust 82 of the engine 60.

Preferably, the fuel in the source 104 is the same fuel utilized to power the main engine 60, typically a hydrocarbon fossil fuel such as diesel fuel. Consequently, no special logistic support or fuel source is needed to operate the black smoke generator 90 shown in FIG. 2. Since the smoke generator 90 utilizes only excess compressed air from the turbocharger compressor 62, no measurable degradation of the main engine power 60 is experienced during operation of the black smoke generator 90.

From the foregoing, it can be seen that the present invention provides an improved black smoke generator for use with military vehicles, installations or the like which provides not only a visual screen but also improved infrared shielding.

Having described my invention, however, many modifications thereto will become apparent to those skilled in the art to which it pertains without deviation from the spirit of the invention as defined by the scope of the appended claims.

I claim:

1. An engine turbocharging system comprising:

an air compressor with a compressed air outlet;

an expander with an inlet and an exhaust outlet;

a combustion means operatively connected to said compressor outlet and said expander inlet;

a burner assembly having a housing defining a combustion chamber, said housing having an air inlet and an exhaust outlet open to said burner combustion chamber, said compressor outlet being fluidly connected to the burner inlet so that a portion of the compressed air from the compressor enters the burner combustion chamber, said burner exhaust outlet being fluidly connected to said expander outlet;

means for supplying fuel to the burner combustion chamber at a rate which produces an excessively rich fuel/air mixture in the burner combustion chamber to generate black smoke; and means for igniting the fuel/air mixture in the burner combustion chamber.

2. The invention as defined in claim 1 wherein said means for fluidly connecting said compressor outlet to said burner inlet further comprises a restrictor valve.

3. The invention as defined in claim 1 wherein said means for fluidly connecting said compressor outlet to said burner inlet comprises a shut off valve for selectively fluidly disconnecting said compressor outlet from said burner inlet.

* * * * *